US005412825A

United States Patent [19]

Moon

[11] Patent Number: 5,412,825

[45] Date of Patent: May 9, 1995

[54] TOP COVER LOCKING SYSTEM OF A BOILING CLOTHES WASHING MACHINE

[75] Inventor: Kyung H. Moon, Suweon, Rep. of Korea

[73] Assignee: Samsung Electronics Co., Ltd., Suwon, Rep. of Korea

[21] Appl. No.: 963,633

[22] Filed: Oct. 20, 1992

[30] Foreign Application Priority Data

Oct. 21, 1991 [KR] Rep. of Korea ..... 91-18529

[51] Int. Cl.[6] ..... D06F 37/42

[52] U.S. Cl. ..... 8/159; 68/12.26; 68/15

[58] Field of Search ..... 68/12.26, 15; 8/158, 8/159; 134/57 DL, 58 DL

[56] References Cited

U.S. PATENT DOCUMENTS

| | | | |
|---|---|---|---|
| 3,015,944 | 1/1962 | Krause | 68/15 |
| 3,285,036 | 11/1966 | Erickson | 68/12.26 |
| 3,621,165 | 11/1971 | Stone | 68/12.26 |
| 3,709,836 | 1/1973 | Inamorato . | |
| 4,120,013 | 10/1978 | Simmons | 68/12.26 |
| 4,245,309 | 1/1981 | Kiefer | 68/12.26 |
| 4,510,777 | 4/1985 | Ellingson et al. | 68/12.26 |
| 5,001,910 | 3/1991 | Harmelink et al. | 68/12.26 |

OTHER PUBLICATIONS

E.P. 381,022 Aug. 1990.

*Primary Examiner*—Frankie L. Stinson
*Attorney, Agent, or Firm*—Burns, Doane, Swecker & Mathis

[57] ABSTRACT

A top cover locking system and a method for a boiling clothes washing machine includes a microcomputer for controlling the operation of the system. A heater boils the washing water along with clothes to be washed. A top cover locking system is provided with a switch for detecting the opening/closing of the top cover. The detected signal is applied to the microcomputer, and a solenoid valve locks or releases the top cover according to the control signal from the microcomputer during the boiling wash and dehydrating modes, thereby preventing accidents and promoting thermal efficiency.

4 Claims, 4 Drawing Sheets

TOP COVER LOCKING SYSTEM OF A BOILING CLOTHES WASHING MACHINE

FIELD OF THE INVENTION

The present invention relates to a boiling clothes washing machine including a heater for laundering the clothes with hot water, and particularly, to a top cover locking system for a boiling clothes washing machine for locking a top cover disposed on the housing of the washing machine during a boiling wash mode and a dehydrating mode.

BACKGROUND OF THE INVENTION

A conventional fully automatic clothes washing machine has been developed to provide a normal heating apparatus in a tub in order to wash clothing with warm water heated over approximately 50° C. The tub includes only a top cover mounted on the upper part of the tub, thus providing direct accessibility thereto. The machine operator is exposed directly to warm water when the top cover is opened, thereby creating a risk to the operator of being burned by boiling water. Therefore, the washing machine automatically stops the operation of the heater, if the top cover is opened. Furthermore, the conventional washing machine forces the washing tank to rotate at a high speed during the dehydrating mode. When the top cover is opened, the sudden stopping generates a warning sound, and inertia causes the washing tank to continue to rotate, thereby flushing the washing water out of the tub during the dehydrating of clothes.

On the other hand, it is expected that a boiling clothes washing machine will be developed to heat washing water over the boiling point of approximately 95° C. Actually, such a machine is necessary to obtain sterilization, deodorization and bleaching when washing clothes which can withstand a high temperature, which are seriously contaminated or which will not discharge their printing. This washing method can be realized by boiling the washing water. The boiling washing machine must assure sufficient sealing for the steam vapor leaking from the tub in order to prevent damage to the electrical parts of the washing machine.

Therefore, it should be noted that the conventional top covers used in these washing machines cannot be adapted to a boiling clothes washing machine.

An object of the present invention is to provide a top cover locking system and a method for a boiling clothes washing machine for performing boiling wash and dehydrating modes only under a locked condition of the top cover, thereby promoting safety.

Another object of the present invention is to provide a top cover locking system and a method for a boiling clothes washing machine for performing a boiling wash mode only under the locked condition of the top cover, thereby enhancing thermal efficiency.

SUMMARY OF THE INVENTION

According to the present invention, a boiling clothes washing machine includes a microcomputer for controlling the operation of the system and a heater for boiling the washing water along with the clothes to be washed. A top cover locking system of the boiling clothes washing machine includes means for detecting the opening/closing of the top cover and for applying the detected signal to the microcomputer. It also includes a solenoid, a triac and a resistor for locking/releasing the top cover according to the control signal from the microcomputer during the boiling wash and the dehydrating cycles.

Also, the boiling clothes washing machine includes a microcomputer for controlling the operation of the system and a heater for boiling the washing water along with the clothes to be washed. A top cover locking method for the boiling clothes washing machine includes the steps of determining whether a boiling wash mode or a dehydrating mode is to be performed; determining whether the top cover is locked during the boiling wash and dehydrating modes; stopping the operation of the boiling wash mode or the dehydrating mode, if the top cover is opened; and warning of the opening of the top cover, and locking the top cover in order to perform the boiling wash mode or the dehydrating mode.

BRIEF DESCRIPTION OF THE DRAWINGS

The present invention will now be explained in detail with reference to the accompanying drawing, in which.

DETAILED DESCRIPTION OF THE INVENTION

Figure 1A:
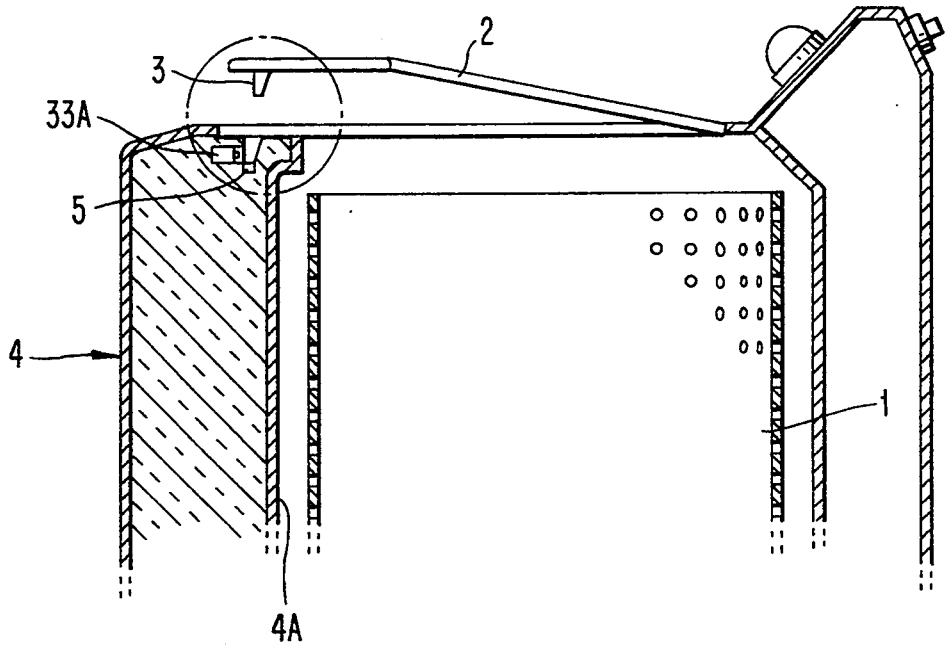
FIGS. 1A and 1B are partial cross-sectional views illustrating a top cover locking apparatus adapted to a boiling clothes washing machine according to the present invention.
Figure 1B:
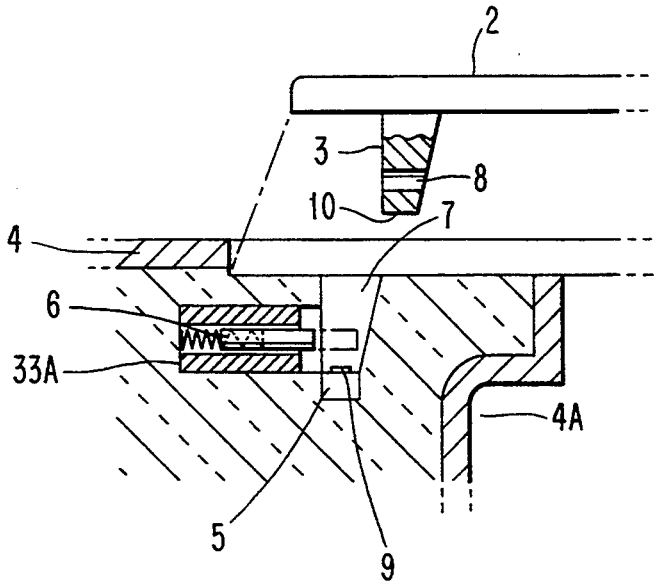

Referring to FIG. 1, a boiling clothes washing machine comprises a housing 4, an inner portion or tub 4A. A washing tank 1 is properly positioned in the tub to rotate in the forward and reverse directions. A top cover 2 is pivotally hinged to the upper rear side of the housing 4. The lower portion of suspending member 3 cooperates with a tap 9 which is fixed near the front end of the tub. A through-hole 8 is formed at a predetermined height of the suspending member 3 to receive a reciprocating rod 6 of a solenoid valve 33A, as described below in detail. A receiving recess 7 is formed on the upper surface of the housing 5 to permit the suspending member 3 to be seated and to be fitted thereinto. A top cover opening/closing detecting switch 5 is mounted in the receiving recess 7 to detect the opening or closing state of the tub cover 2 by pressing the detecting switch 5 when the top cover is closed. The solenoid valve 33A is mounted adjacent to the peripheral portion of the receiving recess 7 to lock/release the reciprocating rod 6 into the through-hole 8.

Figure 2:
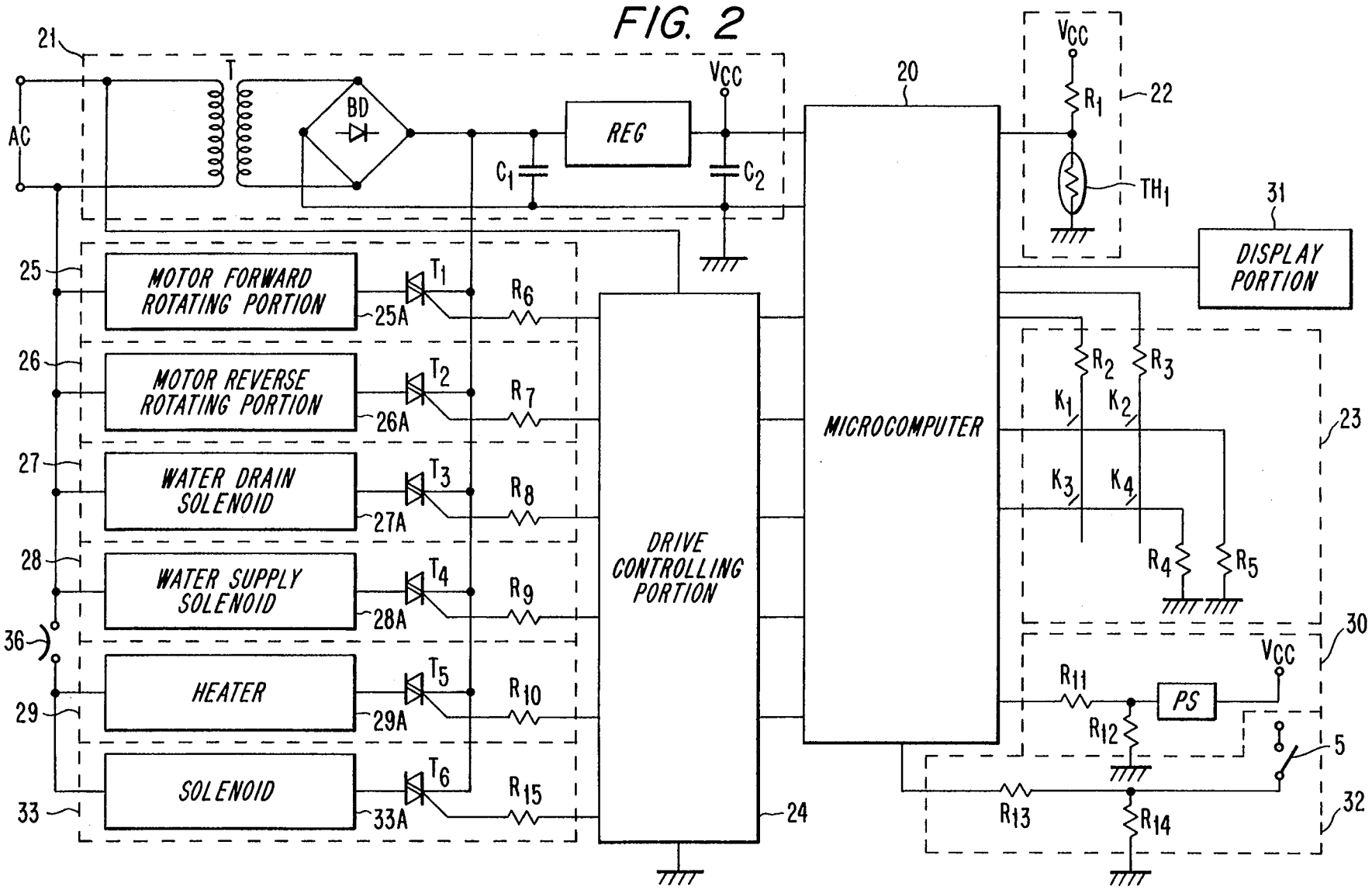
FIG. 2 is a schematic circuit illustrating a top cover locking system adapted to a control circuit of a boiling clothes washing machine according to the present invention; and, FIGS. 3A and 3B are a flow chart illustrating a top cover locking method according to the present invention.

Referring to FIG. 2, the present invention includes a control circuit provided with a microcomputer 20 to control the total operation of the boiling clothes washing machine according to the predetermined system program.

A power supply portion 21 includes a transformer T, a bridge diode portion BD, condensers $C_1$ and $C_2$ and a precision regulator PEG to rectify the alternate current into the constant power source so as to supply a regulate voltage Vcc to the system.

A washing water temperature detecting portion 22 includes a thermistor $Th_1$ and a resistor $R_1$ to sense the temperature of the washing water lo be supplied to the tub.

A function selecting portion 23 includes a number of key K1 to K4 in a matrix arrangement and a number of resistors $R_2$–$R_5$ connected to each corresponding key, for selecting the wash mode or the corresponding procedure and the operating times corresponding to each mode or procedure.

A drive controlling portion 24 operates a number of loads under the control of the microcomputer 20 according to the output signals from the washing water temperature detecting portion 22 and the function selecting portion 23.

A motor forward rotating drive portion 25 includes a motor forward rotating portion 25A for rotating the motor, forwardly, a triac $T_1$ triggered by the output signal from the drive controlling portion 23, and a resistor $R_6$.

A motor reverse rotating drive portion 26 includes a motor reverse rotating portion 26A for rotating the motor, reversely, a triac $T_2$ triggered by the output signal from the drive controlling portion 23, and a resistor $R_7$.

A water drain drive portion 27 includes a water drain solenoid valve 27A for draining the washing water, a triac $T_3$ triggered by the output signal from the drive controlling portion 23, and a resistor $R_8$.

A water supplying drive portion 28 includes a water supply solenoid valve 28A for supplying washing water, a triac $T_4$ triggered by the output signal from the drive controlling portion 23, and a resistor $R_9$.

A heater operating portion 29 includes a heater 29A for heating the washing water, a triac $T_5$ triggered by the output signal from the drive controlling portion 23, and a resistor $R_{10}$.

A water level sensing portion 30 includes a pressure sensor PS and resistors $R_{11}$ and $R_{12}$ to sense the level of the washing water to be supplied.

A display portion 31 displays the completion of each of the washing procedures, the function selections, etc.

A top cover 2 opening/closing portion 32 includes a top cover detecting switch 5 for detecting the opening/closing of the top cover 2 and resistors $R_{13}$ and $R_{14}$.

A top cover locking portion 33 includes a solenoid valve 33A for locking/releasing the top cover, a triac $T_6$ triggered by the output signal from the drive controlling portion 23, and a resistor $R_{15}$. The top cover is locked on the upper portion of the boiling clothes washing machine during a boiling wash mode and a dehydrating mode.

Figure 3A:
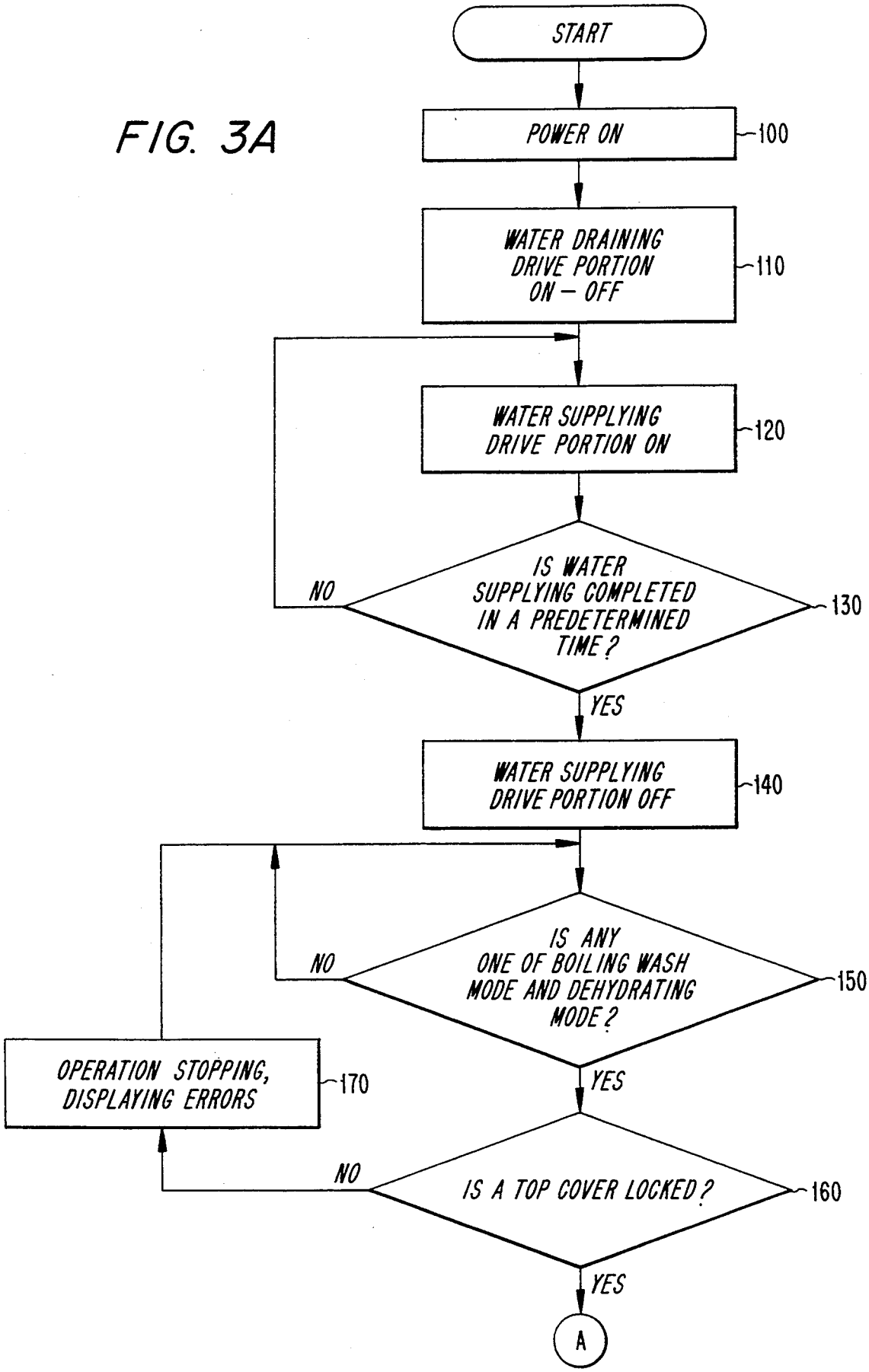
Figure 3B:
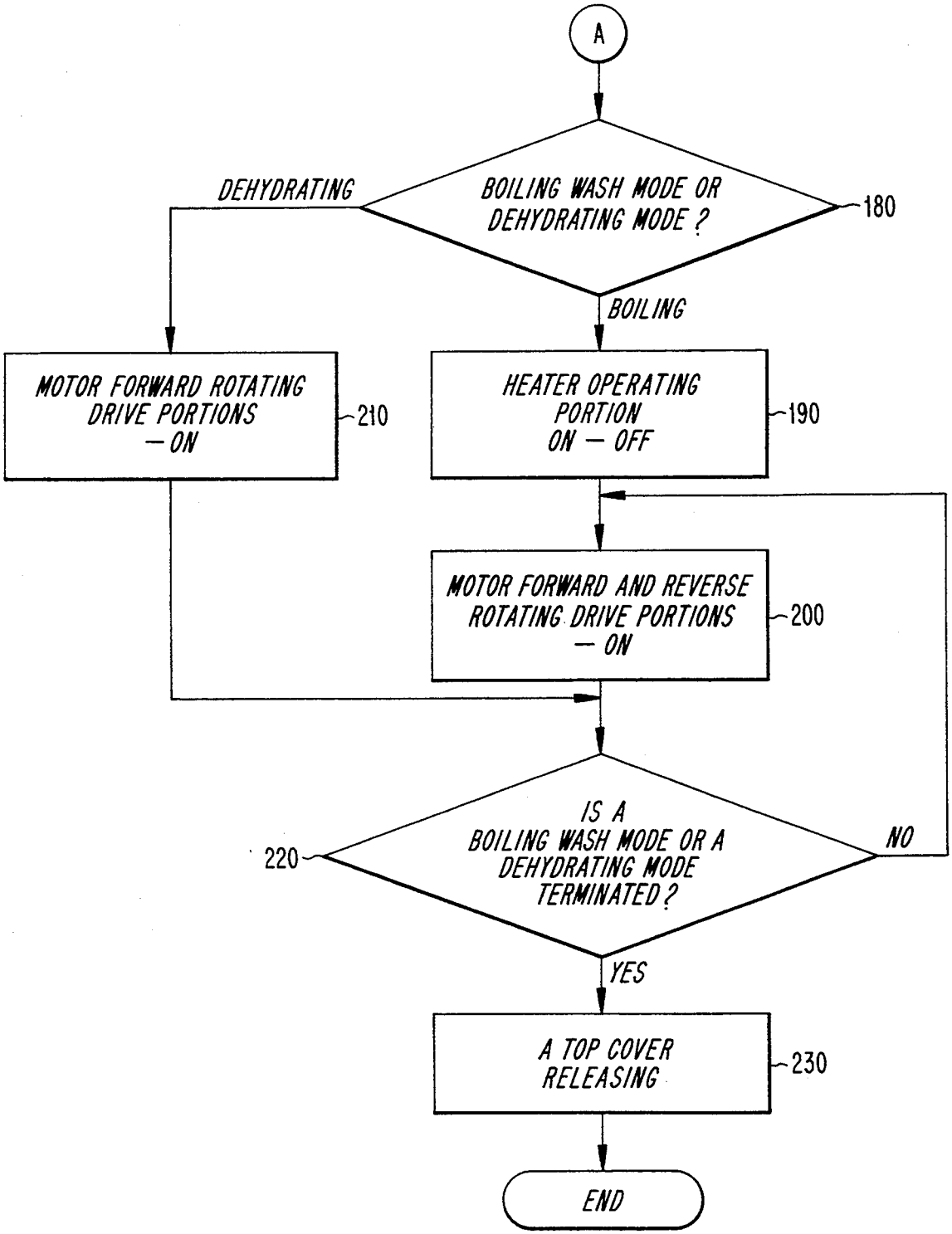

Referring to FIG. 3, a flow chart illustrates the gist of the present invention, and an explanation of the system operation is omitted for matter outside the scope of the attached claims.

A top cover locking method begins with the step 100 of initializing the system by turning on the power source. Step 110 includes operating the water drain drive portion 27 until the complete draining of used washing water from the tub and then turning it off. Step 120 includes turning on the water supplying drive portion 28. Step 130 includes determining whether the water supply is completed after a predetermined time lapse and returning to step 120, if it is not completed. Step 140 includes turning off the water supplying drive portion 140, if the water supply is completed. These steps are performed similar to an existing fully automatic washing machine.

In order to perform the top cover locking method according to the present invention, step 140 advances to step 150 to determine whether a boiling wash mode or a dehydrating mode is to be performed. If either of them is selected, step 150 advances to step 160 to determine whether the top cover 2 is closed. If the top cover is open, step 170 is performed to enable a display 31 to convey information instructing the operator to close the top cover 2 as well as to command that the boiling wash more or the dehydrating mode not be carried out. Otherwise, the top cover locking portion 33 receives the control signals from the microcomputer 20 to operate the solenoid valve 33A. The reciprocating rod 6 is then inserted into the through-hole 8 to lock the top cover 2 to the upper portion of the housing 4.

Next, step 160 advances to step 180 to determine whether the boiling wash mode or the dehydrating mode has been selected. If the dehydrating mode has been performed, step 210 is performed to dehydrate the clothes being washed. If the boiling wash mode has been performed, at step 190 the heater operating portion 29 is turned on to heat the washing water along with clothes for a predetermined time period. Then it is turned off. Step 190 advances to step 200 to rotate a motor in forward and reverse directions by turning on the motor forward and reverse rotating drive portions 25 and 26. Then, step 200 advances to step 220 to determine whether the boiling wash mode or the dehydrating mode is finished. If either of them is finished, step 220 advances to step 230 to automatically release the top cover 2 by turning off the top cover locking portion 33.

As described above, a top cover locking system and a method for a boiling clothes washing machine allows a boiling wash mode to generate steam vapor at a high temperature. The washing water is heated and a dehydrating mode rotates the washing tank at a high speed only when the top cover is locked, thereby preventing accidents and promoting thermal efficiency.

What is claimed is:

1. A boiling clothes washing machine of the type having a heater for boiling water, wherein the improvement comprises:

a cover;

means for detecting the opening and closing of the cover and for generating detection signals;

a microcomputer, responsive to the detection signals, for generating control signals; and means, responsive to said control signals, for locking and releasing the cover during a boiling wash mode and a dehydrating mode.

2. A boiling clothes washing machine according to claim 1 wherein in the means for locking and releasing the cover includes a solenoid, a triac and a resistor.

3. A method for controlling a boiling clothes washing machine having a heater for boiling water, including the steps of:

determining whether a boiling wash mode or a dehydrating mode is to be performed;

determining whether a cover is locked during the boiling wash mode or the dehydrating mode;

stopping the operation of the boiling wash mode and the dehydrating mode, if the cover is not locked; and locking the cover to perform the boiling wash mode or the dehydrating mode.

4. A method according to claim 3 which further includes the step of providing a warning, if the cover is not locked.

* * * * *